United States Patent [19]

Crane

[11] Patent Number: 4,717,085

[45] Date of Patent: Jan. 5, 1988

[54] DOCUMENT SHREDDING MACHINES

[75] Inventor: Denis P. Crane, Olton, United Kingdom

[73] Assignee: Ofrex Group Holdings Plc, West Drayton, United Kingdom

[21] Appl. No.: 810,418

[22] Filed: Dec. 18, 1985

[30] Foreign Application Priority Data

Dec. 21, 1984 [GB] United Kingdom ..... 8432545

[51] Int. Cl.[4] ..... B02C 18/22; B02C 18/44

[52] U.S. Cl. ..... 241/236; 241/292.1

[58] Field of Search ..... 241/235, 236, 292.1, 241/294, 295

[56] References Cited

U.S. PATENT DOCUMENTS 4,241,882 12/1980 Baikoff ..... 241/236

4,260,115 4/1981 Hatanaka ..... 241/236

FOREIGN PATENT DOCUMENTS 2542632 9/1984 France ..... 241/236

*Primary Examiner*—Timothy V. Eley

*Attorney, Agent, or Firm*—Vaden, Eickenroht, Thompson & Boulware

[57] ABSTRACT

A document shredding machine comprises cutting mechanism comprising two shafts, each mounted for rotation about a respective parallel axis, and cutting discs mounted at spaced intervals on each shaft, the two sets of cuttings discs intermeshing and the shafts being rotated in opposite directions so as to provide a downwardly-accessible nip into which documentary material (such as paper) is fed. Engagement between the circumferential edges of adjacent discs subjects the documentary material to a plurality of longitudinal cuts, and the discs are provided with transverse cutting edges by which the material is subjected to a transverse severing.

4 Claims, 4 Drawing Figures

DOCUMENT SHREDDING MACHINES

BACKGROUND OF THE INVENTION

This invention is concerned with improvements relating to shredding machines of the kind such as are used to comminute documentary material, and particularly of the kind (hereinafter referred to as being of the kind specified) comprising a housing, cutting mechanism mounted on the housing, said mechanism comprising two shafts, each mounted for rotation about a respective parallel axis, and cutting discs mounted at spaced intervals on shaft, the cutting discs intermeshing and the shafts being rotated in opposite directions so as to provide a downwardly-accessible nip into which documentary material (such as paper) may be fed. The engagement between the circumferential edges of adjacent discs subjects of the documentary mateial to a plurality of longitudinal cuts, and the discs are provided with transverse cutting edges by which the material is subjected to a transverse severing. A machine of this kind is described in U.S. Pat. No. 4,426,044.

Difficulties are encountered in mounting the discs on their respective shafts in a manner such that shock loading (which happens when a large number of cutting edges enter the nip simultaneously) is minimized, and in a manner in which there is no significant axial load on the discs, as may cause them to bind further. Desirably the discs are mounted on the shafts in a manner which is conducive to simplicity of manufacture and assembly.

SUMMARY OF THE INVENTION

According to this invention there is provided a shredding machine of the kind specified wherein the cutting discs on each shaft comprise a first set, the cutting edges of which are located on a first set of helices (one for each cutting edge of the disc) disposed around the longitudinal axis of the shaft, and a second set, the cutting edges of which are located on a second set of helices (one for each cutting edge of the disc) disposed around the longitudinal axis of the shaft, each helix of the second set being disposed between two helices of the first set.

The cutting discs may comprise a third set, the cutting edges of which are located on a third set of helices (one for each cutting ege of the disc) disposed around the longitudinal axis of the shaft, the cutting discs of the first set comprising each third disc (e.g. numbering the discs in sequence on the shaft, discs Nos. 1, 4, 7, 10 . . . ) whilst those of the second set comprise discs adjacent to and on one side of each disc of the first set (e.g. discs Nos. 2, 5, 8, 11 . . . ) whilst those of the third set comprise discs adjacent to and on the other side of each disc of the first set (e.g. discs Nos. 3, 6, 9, 12 . . . ), the three sets of helices being uniformally disposed around the longitudinal axis of the shaft in alternating manner.

Preferably however the cutting discs comprise only two sets of helices, and the helices of both the first and second sets are uniformally disposed in alternating manner around the longitudinal axis of the shaft. Thus, the cutting discs of the first set may comprise alternate discs on the shaft, whilst the cutting discs of the second set comprise the intervening cutting discs.

In this manner a single design of cutting disc may be utilised, comprising a mounting formation for co-operation with a mounting formation on the shaft, the mounting formation being positioned in relation to the cutting edges of the disc in a manner such that successive discs on the shaft are reversed, or at alternating orientations with respect to one another.

Thus, each disc may comprise an odd number of cutting edges, and the discs and the shaft may each comprise two mounting formations off-set axially by 180°.

Preferably the helix angle is small, i.e. each helix completes less than one circumscription of the longitudinal axis, and advantageously the helix completes only a fraction of one circumscription, preferably 1/a of one circumscription, where a is the number cutting edges per disc.

In this manner, considering the discs of one set, the cutting edge of one disc alone of the first set enters the nip and thereafter a cutting edge of each successive disc of said one set enters the nip in progression lengthwise of the shaft, to one end of the shaft, and continuing with entering of the nip by a cutting edge of the first disc of said one set at the opposite end of the shaft. Thus, the nip entry sequence of the discs of said one set is as a single wave repeatedly running lengthwise of the shaft.

Meanwhile, the cutting edges of the discs of the second set enter the nip in a similar sequence, as a second wave spaced from the first by half the operative length of the shaft.

Additionally, particularly where the cutting edges are provided by teeth, difficulty is encountered in ensuring that the teeth cut cleanly through the documentary material being shredded, and do not tear the material.

According to this invention there is provided a cutting disc for a document shredding machine of the kind specified, the cutting edges of the disc being provided by tooth formations on the disc, the outermost surfaces of each of which tooth formations extends (from a root portion to a tip portion) inwardly of a tangent to the root portion.

Thus, the outermost parts of the disc will be the outermost edges of the root portions of the tooth formations, from which the teeth extend inwardly. Thus, as the teeth enter the nip, they will pass through the documentary material and exert on the documentary material a component of force which tends to pull the material slightly towards the axis of the shaft upon which the disc is mounted. This results in a complete communication of the documentary material into "chips", and enables a larger number of sheets to be fed through simultaneously.

Preferably the root of the teeth, in the direction of movement of the teeth, are recessed, preferably in curved form, which compresses the shredded material.

DETAILED DESCRIPTION OF A PREFERRED EMBODIMENT

Figure 1:
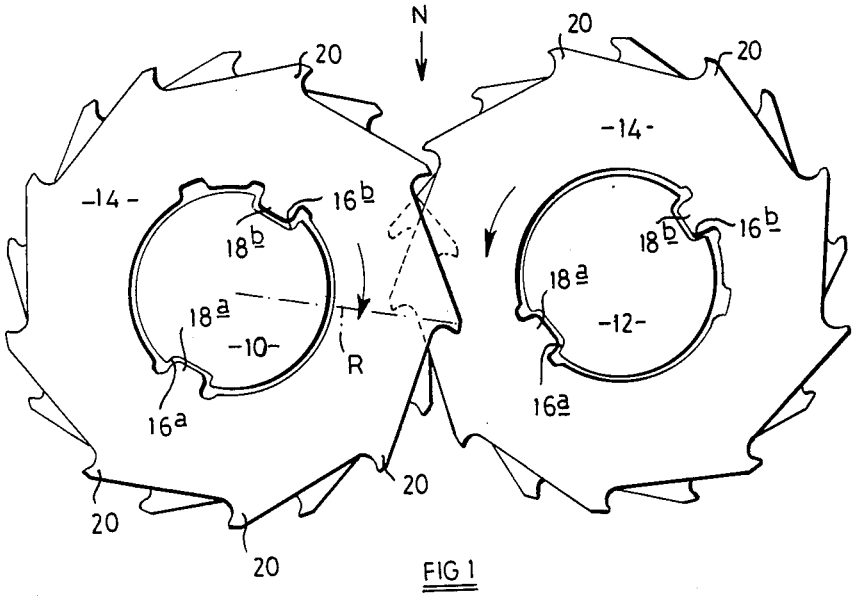
FIG. 1 is a side elevation showing interengagement of the discs of the cutting mechanism of a shredding machine which is a preferred embodiment of this invention.

The machine which is the preferred embodiment of this invention comprises a cutting mechanism comprising two cutter assemblies each comprising a shaft 10, 12 on which are mounted alternately cutting discs 14 and spacers 15. Each shaft comprises mounting formations, afforded by respective peripheral channels 16*a*, 16*b* mutually disposed at 180° to each other, each extending lengthwise of the shaft, and partially circumscribing the shaft, in the form of a respective shallow helix. Each cutting disc 14 is generally annular in shape, and comprises mounting formations afforded by two tangs 18*a*, 18*b* extending radially inwardly into the central aperture of the disc, the tangs also being disposed at 180° to one another.

Each disc is provided, uniformly disposed around its circumference, with a odd number of, specifically nine, cutting formations 20.

The helix angle of the channels 16*a*, 16*b* is such that each channel occupies an angle of slightly less than 40° about the axis of the shaft, i.e. approximately one ninth of a circumscription of the axis.

The cutting discs 14 are mounted on the shafts in the following way. On each shaft a cutting disc is mounted in a first orientation (e.g. with the tang 18*a* in the channel 16*a*) followed by a spacer member, followed by a cutting disc in a second orientation (e.g. with the tang 18*a* in the channel 16*b*), followed by another spacer member and another disc in the first orientation.

Thus, the cutting formations 20 of the first set of discs (i.e. the set comprising those discs in the first orientation) define, over the length of the shaft, 9 helices which also subtend an angle of approximately 40° at the longitudinal axis of the shaft. The cutting formations of the second set of discs (i.e. the set comprising those discs in the second orientation) similarly define, over the length of the shaft, 9 further helices which are uniformally disposed between the first 9 helices.

The cutting discs are mounted in a similar manner on the other shaft, the shafts being so positioned that the cutting discs on one shaft are in permanent intermesh with those on the other shaft.

Figure 3:
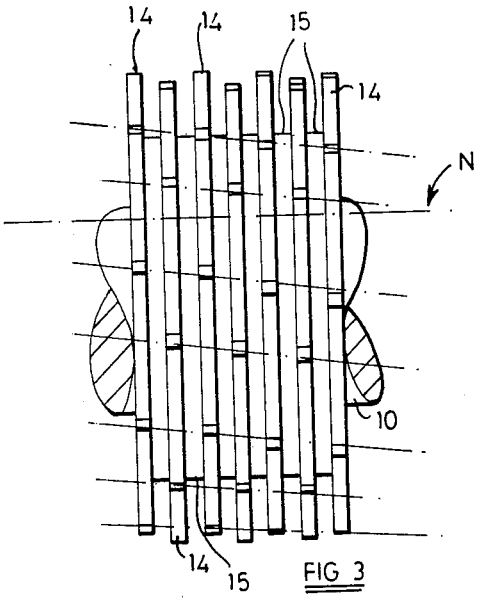
FIG. 3 is a side elevation of part of cutting mechanism.

Considering the nip N to be aligned parallel to and generally between the two shafts, at a position approximately where the discs commence meshing, only one of the cutting formations of each set of cuttings discs on each shaft will be approaching the nip N at any one time, those cutting formations being spaced apart by approximately half the length of the shaft. For each set of cutting discs, the next cutting formation to enter the nip will be on the immediately adjacent disc of the respective set on a specific side of the disc comprising the cutting formation presently entering the nip (e.g. to the left, as viewed in FIG. 3), and this will be repeated. When a cutting formation of the end most disc of a set has entered the nip, the next cutting formation of the discs of that set to enter the nip will be that on the opposite end-most disc, at the opposite end of the shaft. Thus, the nip entry sequence for the discs on each shaft is in the form of two points continually moving lengthwise of the shaft from one end to the other, and starting again from said one end.

Figure 4:
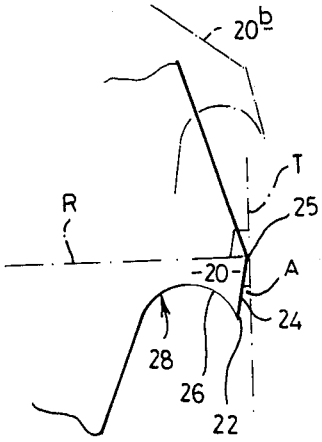
FIG. 4 is an enlarged view of part of FIG. 1.
Figure 2:
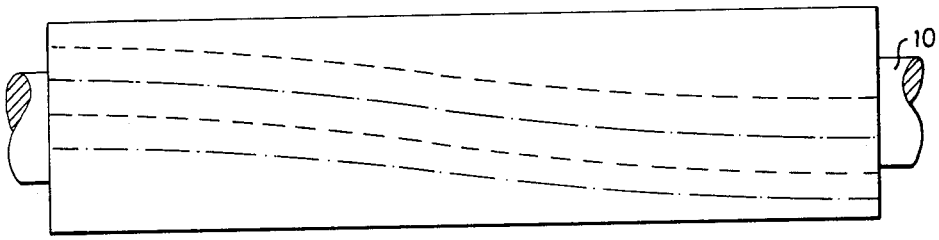
FIG. 2 is a schematic plan view of part of the cutting mechanism.

The cutting formations 20 of the discs 14 are as shown in FIG. 4, each cutting formation 20 being in the form of a tooth which provides a cutting edge 22 at the tip which extends across (at right angles to the same Figure) the thickness of the disc. The formation comprises an outer surface 24 which is inclined (in the direction of cutter movement) inwardly from a tangent (T) at the outermost edge 25 of the tooth root.

The outer surface 25 may be flat, at a small angle A to the tangent, as is shown in FIG. 4, but is preferably curved, being formed by rotation of the disc about its centre and moving the disc into contact with a grinding surface. The opposite, inner surface 26 of the tooth is afforded by a rearward curved recess 28 in the disc. Thus on movement of the cutting edge of the disc into engagement with the material being shredded (e.g. in a position occupied by tooth 20*b* in FIG. 4) the material will be penetrated by the cutting edge 22, and will be pulled marginally away from the vertical centreline, increasing the reliability of the vertical cut afforded by the intermeshing edges of the discs, thereby facilitating shredding of any given document, and enabling an increased thickness or number of sheets of documentary material to be shredded in a single shredding operation, and the resultant shredded material is compressed into a high density "chip".

Having now particularly described and ascertained the nature of my said invention and in what manner the same is to be performed I declare that what I claim is:

1. In a document shredding machine, a cutting mechanism comprising two shafts mounted for rotation about parallel axes, cutting discs at spaced intervals on each shaft with the discs on one shaft intermeshing with the discs of the other shaft, means for rotating the shafts in opposite directions so as to provide a downwardly-accessible nip into which documentary material may be fed, the discs being provided with transverse cutting edges to subject the material to a transverse severance, the cutting discs on each shaft being arranged in a plurality of sets with the cutting edges of the discs of each set being located on helices corresponding in number to the cutting edges of each disc and extending longitudinally of the shaft and circumferentially intermediate the adjacent helices on which the cutting edges of the discs of adjacent sets are located, and the discs of each set alternating longitudinally with the discs of each adjacent set.

2. A cutting mechanism of the character defined in claim 1, wherein each disc of each set has an odd number of equally spaced cutting edges, a central hole therethrough for fitting about a shaft, and diametrically opposed parts for engaging diametrically opposed parts on the shaft, whereby the cutting edges of adjacent discs are circumferentially staggered when the parts thereof are diametrically reversed.

3. In a document shredding machine, a cutting mechanism comprising two shafts mounted for rotation about parallel axes, cutting discs at spaced intervals on each shaft with the discs on one shaft intermeshing with the discs of the other shaft, means for rotating the shafts in opposite directions so as to provide a downwardly-accessible nip into which documentary material may be fed, the discs being provided with transverse cutting edges to subject the material to a transverse severance, the cutting discs on each shaft being arranged in a plurality of sets with the cutting edges of the discs of each set being located on helices corresponding in number to the cutting edges of each disc and extending longitudinally of the shaft and circumferentially intermediate the adjacent helices on which the cutting edges of the discs of adjacent sets are located, the circumferential extent of each helix being not greater than 360° divided by the number of cutting edges of each disc, and the helices of each set being substantially equally spaced circumferentially of the helices of adjacent sets.

4. A cutting mechanism of the character defined in claim 3, wherein the discs of each set alternate longitudinally with the discs of each adjacent set.

* * * * *